United States Patent [19]

Prohazka et al.

[11] 4,291,731

[45] Sep. 29, 1981

[54] MECHANISM FOR LAUNCHING GRIPPERS IN GRIPPER LOOMS

[75] Inventors: Miloslav Prohazka, Nachod; Karel Kaulich, Cerveny Kostelec, both of Czechoslovakia

[73] Assignee: ELITEX, koncern textilniho strojirenstvi, Liberec, Czechoslovakia

[21] Appl. No.: 45,935

[22] Filed: Jun. 6, 1979

[30] Foreign Application Priority Data

Jun. 6, 1978 [CS] Czechoslovakia ..... 3663-78

[51] Int. Cl.[3] ..... D03D 47/42; D03D 49/24

[52] U.S. Cl. ..... 139/438; 139/142; 139/449

[58] Field of Search ..... 139/142, 145, 449, 437–439; 403/58, 57, 59, 157

[56] References Cited

U.S. PATENT DOCUMENTS

| | | | |
|---|---|---|---|
| 1,945,996 | 2/1934 | Rossmann | 139/142 |
| 2,589,429 | 3/1952 | Pfarrwaller | 139/439 |
| 2,715,422 | 8/1955 | Pfarrwaller | 139/145 |
| 2,773,517 | 12/1956 | Hopper et al. | 139/142 |
| 2,960,341 | 11/1960 | Emrick | 403/57 X |

FOREIGN PATENT DOCUMENTS

| | | | |
|---|---|---|---|
| 1124078 | 6/1956 | France | 139/142 |
| 1399440 | 4/1965 | France | 139/449 |
| 56731 | 6/1967 | German Democratic Rep. | 139/449 |
| 660041 | 1/1964 | Italy | 139/449 |

*Primary Examiner*—James Kee Chi

[57] ABSTRACT

Mechanism for launching grippers in gripper looms, in which the launching power source is stationary and the gripper is provided with a guideway and means for controlling and defining the gripper path, such means being connected to the beat-up mechanism of the loom. The mechanism has a launching arm and an impact element which is connected thereto by means of a connecting rod and pivotal joints on the launching arm, as well as on the impact element, each of which provides for two degrees of freedom of motion between each pair of parts which it connects.

4 Claims, 1 Drawing Figure

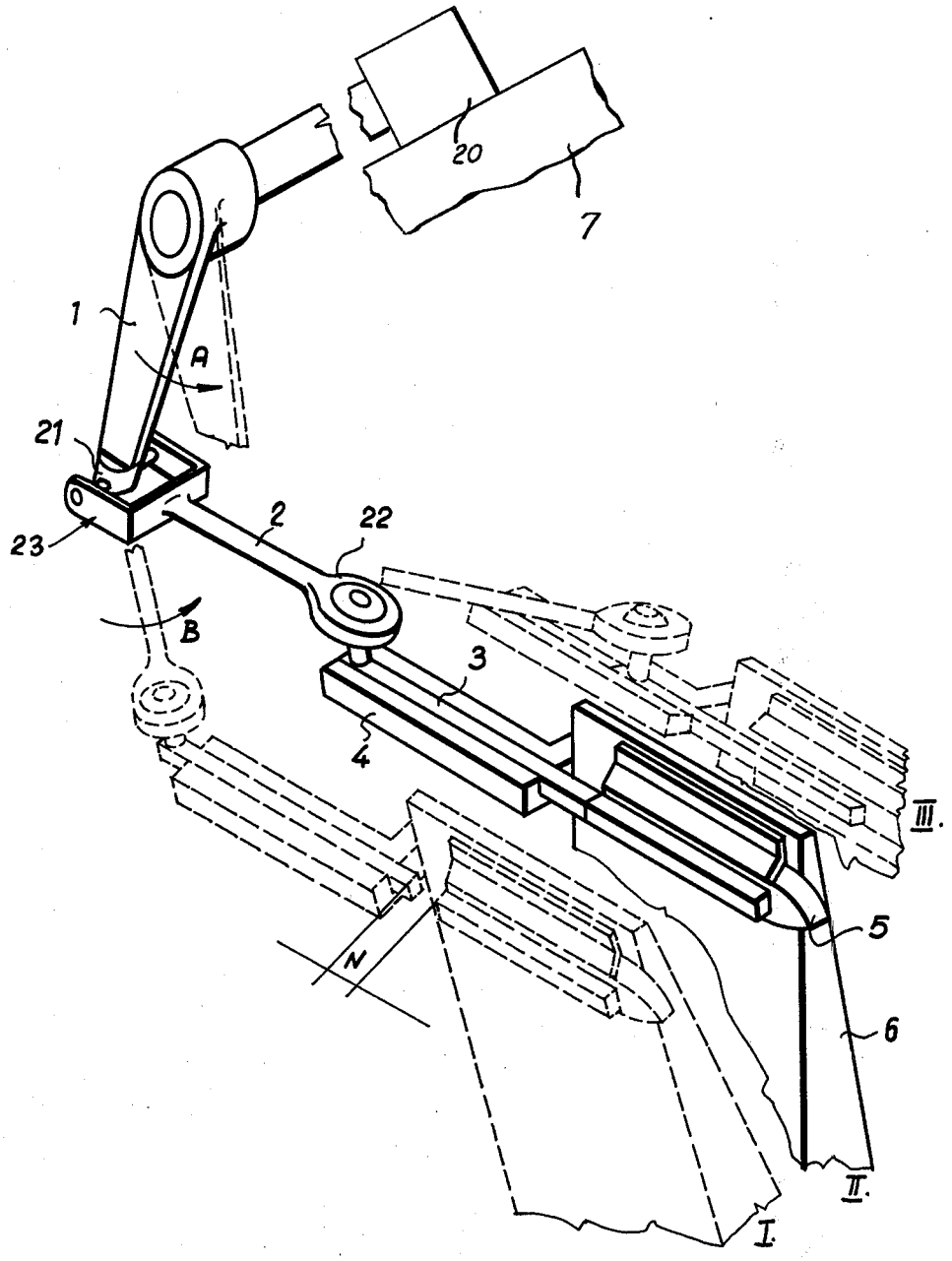
20
7
1
A
21
23
2
22
B
3
4
III.
5
N
6
II.
I.

MECHANISM FOR LAUNCHING GRIPPERS IN GRIPPER LOOMS

The present invention relates to a mechanism for launching grippers in gripper looms.

Mechanisms for launching shuttles in mechanical looms and for launching small shuttles—weft inserters—i.e. grippers in gripper looms are known. In such prior mechanisms the necessary launching force is derived from springs, a pneumatic or hydraulic pressure device, or another equivalent device.

The known mechanisms are based in their designs on two principles. In the first case, the whole mechanism is stationary and the actual launching of the gripper takes place at the rest position of the slay of the loom, on which there are mounted guiding elements for the gripper entraining the weft thread. The advantage of such arrangement consists in the reduction of the mass of the moving parts and thus in simplifying the whole slay drive for oscillating motion, which is usually performed about a circular path. On the other hand, even a short step of the slay has an unfavorable influence on the course of the path. This appears most distinctly in the acceleration at the dead centers.

The other system has the mechanism for gripper launching directly connected to the loom slay; this causes an increase in the mass of the moving parts and, in other than mechanical devices, also requires a connection to a part comprising the pressure source, such arrangement being rather demanding at higher speeds. A further disadvantage common to both of the above-described known mechanisms is the fulfillment of the condition of securing contact of the power imparting element and the actual body of the grippers at the moment of actual launching of the gripper. The initial velocity of the gripper varies within the range of 18 to 28 m per sec. according to the width of the loom and, if at the moment of launching contact between the impact element with the part to which energy is imparted, i.e. the gripper, is not secured, the useful life of the contact parts of both said parts is very unfavorably influenced. This is particularly critical, when the gripper or its bushing is made of plastic material which has many advantages over steel in connection with the overall arrangement and with the simplicity of the loom as a whole.

The above disadvantages are mitigated in the present invention relating to a mechanism for launching grippers. In accordance with the present invention the connection between the launching arm and the impact element is formed by a connecting rod having on each end a coupling with at least two degrees of freedom.

A particularly advantageous embodiment is one in which the requisite degrees of freedom of the connecting rod at each end thereof is achieved by joints such as cross-pin or ball joints.

The mechanism of the invention makes it possible to perform gripper launching without waiting for the rest position of the slay, and without substantially increasing the mass of the oscillating parts. On the other hand, this arrangement insures a perfect approach and contact of the impact element with the gripper before the moment of launching.

The function, advantages and features of the present invention will become apparent from the following specification and the accompanying drawing, in which:

The single FIGURE is a fragmentary schematic view in perspective of a preferred embodiment of the gripper launching mechanism of the invention.

The mechanism of the invention is intended for use with various types of looms. The following specification is directed to its application to a loom employing reversible one-sided grippers. Therefore, each side of the loom is provided with the same mechanism. For the sake of simplicity, the directing and reversing mechanism of the gripper is neither shown nor described, since this is not necessary to an understanding of the present invention.

Turning now to the drawing, reference number 1 denotes the launching arm, which is the final element of the power train which effects the actual insertion of gripper 5. The power source 20 which is fixedly mounted on the machine frame 7 can be a spring, a reciprocable motor driven by compressed gas or liquid, a rotary element, in electromagnet, a linear motor, or a similar device which oscillates the launching arm 1. The connecting rod 2 transmits power from the launching arm 1 to an impact element 3. The connection between launching arm 1 and connecting rod 2 is formed by a universal joint coupling 23 having a part 21 rotatably mounted on arm 1 to rotate about the longitudinal axis of the arm, also commonly known as a Cardan or Hock's joint, or rubber springs and similar means. The coupling between the impact element 3 and connecting rod 2 is performed by a universal joint shown as a ball journal 22 firmly connected with impact element 3. The coupling on both ends of connecting rod 2 is thus achieved by means of known universal coupling elements each with at least two degrees of freedom.

The body for guiding impact element 3 and the body 6 for guiding gripper 5 form part of a beat-up mechanism, i.e. a loom slay (not shown) which, during operation of the loom, performs an oscillating motion in a programmed cycle from position I to position III. The position II of the device, which is shown in full lines, represents the moment of launching of the gripper, at which time the launching arm 1 imparts to the gripper 5 forward motion in the direction of the arrow A. Arrow B shows the motion of the connecting rod 2 in relation to the variation of distance N between the impact element 3 and the gripper 5 from the maximum value to zero.

The above-described mechanism functions as follows:

It will be assumed that guiding body 4 for the impact element 3 is in position I, and that the guiding body 6 for gripper 5 is situated, after the threading of the weft yarn and turning of gripper 5 in the position shown. At that moment, the launching arm 1 is in its rear position as shown in the drawing. Connecting rod 2, which is of constant length, pulls impact element 3 from the guiding body 6 of gripper 5 through a distance N. Upon the returning of the machine slay and thus simultaneously moving of the guiding bodies 4,6 of both the impact element 3 and the gripper 5 into position II, connecting rod 2 rotates about joint coupling 22. The launching arm 1 is at that time at rest, connecting rod 2 thus displacing impact element 3 in the guiding body 4 by motion in the direction B, said impact element 3 thus approaching gripper 5 as far as contacting the latter. From the viewpoint of construction, the mutual dimensions are adjusted in such manner, that gripper 5 is only slightly initially displaced. The initial velocity of impact element 3 from that motion is very low when compared to the launching velocity. Thus, any damaging of the contact parts of impact element 3 and gripper 5 is avoided.

Upon the reaching of the position II by the machine slay, conditions for launching the gripper are achieved and launching arm 1 moves vigorously in the forward direction A. In that phase, the position of the launching arm 1, the connecting rod 2, and the impact element 3 approaches maximally the line of the path of gripper 5. The device controlling launching arm 1 is firmly coupled in accordance with a program with the operation of the whole loom. In a further phase, the machine slay together with the guiding bodies 4 and 6 move simultaneously with the impact element 3 and the gripper 5 as far as position III. According to the program of operation of the launching mechanism, launching arm 1 returns to its initial position, and together therewith the connecting rod 2 and the impact element 3 also return to their initial positions. The velocity of this motion is relatively low and thus can be reliably transmitted by joint coupling, ball journal 22 and connecting rod 2. In the further phase, the loom slay returns, together with the guiding body of impact element and gripper 4 and 6, back to position I, a new weft yarn being simultaneously supplied and gripper 5 turned, whereupon the whole cycle is repeated.

Although the invention is illustrated and described with reference to a plurality of preferred embodiments thereof, it is to be expressly understood that it is in no way limited to the disclosure of such a plurality of preferred embodiments, but is capable of numerous modifications within the scope of the appended claims.

We claim:

1. Mechanism for launching a gripper in a gripper loom having a beat-up mechanism including a slay, comprising a gripper launching power source fixedly positioned on the loom, a gripper, a guideway for the gripper on the slay, an impact element on the slay, the gripper launching arm connected to and driven by the launching power source, and a connection between the gripper launching arm and the impact element, the connection being formed by a connecting rod having on both its ends couplings with at least two degrees of freedom.

2. Mechanism as claimed in claim 1, wherein the couplings are universal joints.

3. Mechanism as claimed in claim 1, comprising a guiding body mounted on the slay, and wherein the impact element and the gripper are mounted for movement in said guiding body.

4. Mechanism as claimed in claim 1, wherein upon movement of the launching arm forward, gripper launching direction, the positions of the launching arm, the connecting rod, and the impact element move closer to the gripper.

* * * * *